US006592200B2

(12) United States Patent
Wotton et al.

(10) Patent No.: US 6,592,200 B2
(45) Date of Patent: Jul. 15, 2003

(54) INTEGRATED PRINT MODULE AND SERVICING ASSEMBLY

(75) Inventors: Geoff M. Wotton, Battle Ground, WA (US); John A. Barinaga, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 71 days.

(21) Appl. No.: 10/015,908

(22) Filed: Oct. 30, 2001

(65) Prior Publication Data

US 2003/0081042 A1 May 1, 2003

(51) Int. Cl.[7] ..... B41J 2/165; B41J 2/155
(52) U.S. Cl. ..... 347/22; 347/42
(58) Field of Search ..... 347/32, 22, 42, 347/49, 31, 33

(56) References Cited

U.S. PATENT DOCUMENTS 5,943,071 A * 8/1999 Premnath ..... 347/33
6,139,129 A * 10/2000 Tabasso et al. ..... 347/33

* cited by examiner

*Primary Examiner*—Thinh Nguyen

(57) ABSTRACT

A print unit, such as an inkjet printing mechanism, includes a printbar assembly that has print modules and integrated servicing assemblies to service printheads on the print modules. The one or more printheads of the print modules collectively span a width of a print media and deposit an imaging medium, such as ink, onto the print media. The integrated servicing assemblies move from a retracted position within the printbar assembly to a service position to clean and/or cap the one or more printheads of the print modules. A servicing assembly has one or more wipers that correspond to the one or more printheads, such that when the servicing assembly and the print module are positioned in the service position, the wipers clean the printheads. The servicing assembly also has one or more printhead caps that cover the one or more printheads on the print modules.

49 Claims, 9 Drawing Sheets

INTEGRATED PRINT MODULE AND SERVICING ASSEMBLY

TECHNICAL FIELD

This invention relates to printing mechanisms and, in particular, to a page wide array printbar integrating print modules and corresponding servicing assemblies.

BACKGROUND

An inkjet printer includes a printing assembly having a printhead, or printheads, to deposit ink onto a print media, such as paper. A printhead has an orifice plate that is formed with nozzles through which ink drops are "fired", or otherwise ejected, onto the print media to form an image, such as text or a picture. The ink drops dry, or are heated to dry, on the print media shortly after deposition to form the printed image.

There are various types of inkjet printheads including, for example, thermal inkjet printheads and piezoelectric inkjet printheads. For a thermal inkjet printhead, ink droplets are ejected from individual nozzles by localized heating with a heating element located at individual nozzles. An electric current is applied to a heating element to heat it up which causes a small volume of ink to be rapidly heated and vaporized. Once vaporized, the ink is ejected through the nozzle. A driver circuit is coupled to individual heating elements to provide the energy pulses and thereby controllably deposit ink drops from associated individual nozzles. The drivers are responsive to character generators and other image forming circuitry to energize selected nozzles of a printhead for forming images on the print media.

During printing, ink tends to build up at the nozzle orifices of a printhead. This build-up of residual ink can be caused by ink droplets that are not completely ejected from a nozzle, excess ink at the orifice that is not fully vaporized, or ink spatterings that reflect from the print media when the ink is ejected. The small nozzle orifices of a printhead are also susceptible to clogging by quick drying ink, dust particles and paper fibers, and from solids within the ink. Partially or completely blocked nozzles can result in either missing or misdirected ink drops being deposited onto the print media, either of which impairs printing and degrades the print quality.

The printing assembly typically includes a service station having wipers to clean and preserve the functionality of the printheads. The service station includes a wiper, or wipers, for wiping a printhead to remove ink residue and other contaminants that have been deposited or collected on the printhead surface and over the nozzle openings in the printhead surface. A service station can also include a cap, or capping mechanism, which covers a printhead when the printer is not printing to prevent the ink in the nozzles from drying, and to prevent contaminants from collecting in and over the nozzles.

A conventional inkjet printer has a print unit that includes a reciprocating inkjet pen carriage system for travel back and forth across a print zone along an axis that spans a print media, or otherwise spans a printing width. A conventional print unit also includes a service station fixed within the inkjet printer away from the print zone. To service the printhead nozzles of the inkjet pen carriage system, the carriage system travels along the axis and away from the print zone, or outside of the print zone, to the service station.

With the advent of page wide array printbar assemblies having multiple printheads that span the width of a print media, or otherwise span a printing width, there is a need for improved printing mechanisms having printbar assemblies that are accessible to clean the multiple printheads, and service station assemblies that move wipers and printhead caps to the printheads, rather than the printheads being moved to the wipers at a service station.

SUMMARY

A print unit, such as an inkjet printing mechanism, includes a printbar assembly that has print modules with one or more printheads to deposit an imaging medium, such as ink, onto a print media. The one or more printheads of the print modules collectively span a width of a print media, or print region, when the printbar assembly is in a print position.

The printbar assembly also includes integrated servicing assemblies to service printheads on the print modules. A servicing assembly has one or more wipers that correspond to the one or more printheads on a print module, such that when a servicing assembly and a print module are positioned in a service position, the wipers clean the printheads of ink residue and contaminants.

The integrated servicing assemblies move from a retracted position within the printbar assembly to a service position to clean the one or more printheads of the print modules. In addition to having one or more wipers, a servicing assembly has one or more printhead caps that cover the one or more printheads on the print modules.

BRIEF DESCRIPTION OF THE DRAWINGS

The same numbers are used throughout the drawings to reference like features and components.

DETAILED DESCRIPTION

Introduction

The following describes systems and methods for a printing mechanism having printbar assemblies with print modules and integrated servicing assemblies to clean printheads on the print modules: A printbar assembly, also referred to as a page wide array printbar, has printheads that overlap for continuous printing across the width of a print media, and is capable of printing more pages at a faster rate than conventional scanning, or reciprocating, type pen carriage systems that travel back and forth across a print zone to print.

A printbar assembly having print modules and integrated servicing assemblies provides a single compact unit, rather than having both a printbar assembly and a separate servicing assembly. Additionally, integrated servicing assemblies can be quickly positioned to clean the printheads on the printbar assembly with wipers on the servicing assemblies when the servicing assemblies are integrated into the printbar assembly in close proximity to the printheads. The integrated printbar assembly described herein, and the coordination with the print modules and the servicing assemblies, can be implemented in many different printing devices, to include inkjet printing devices.

Exemplary Printer Architecture

Figure 1:
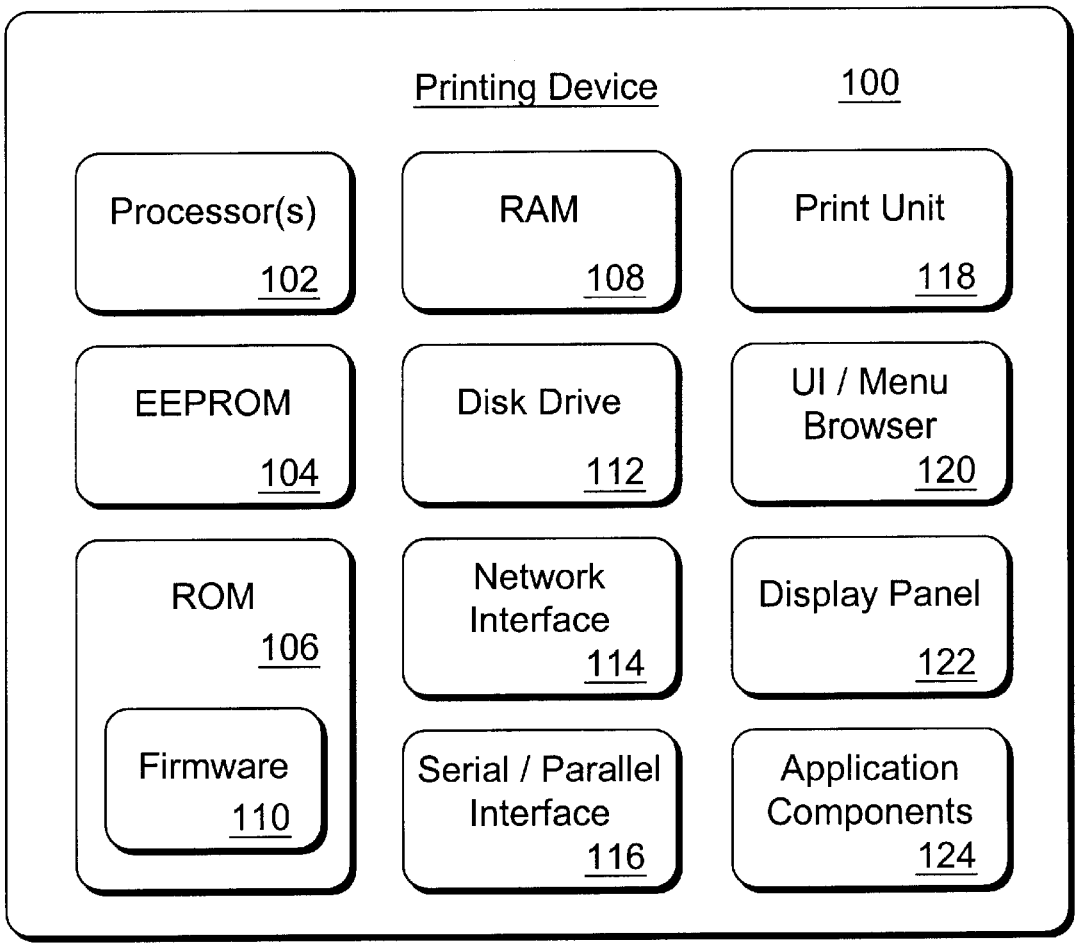
FIG. 1 is block diagram that illustrates various components of an exemplary printing device.

FIG. 1 illustrates various components of an exemplary printing device 100 that can be utilized to implement the inventive techniques described herein. Printer 100 includes one or more processors 102, an electrically erasable programmable read-only memory (EEPROM) 104, ROM 106 (non-erasable), and a random access memory (RAM) 108. Although printer 100 is illustrated having an EEPROM 104 and ROM 106, a particular printer may only include one of the memory components. Additionally, although not shown, a system bus typically connects the various components within the printing device 100.

The printer 100 also has a firmware component 110 that is implemented as a permanent memory module stored on ROM 106. The firmware 110 is programmed and tested like software, and is distributed with the printer 100. The firmware 110 can be implemented to coordinate operations of the hardware within printer 100 and contains programming constructs used to perform such operations.

Processor(s) 102 process various instructions to control the operation of the printer 100 and to communicate with other electronic and computing devices. The memory components, EEPROM 104, ROM 106, and RAM 108, store various information and/or data such as configuration information, fonts, templates, data being printed, and menu structure information. Although not shown, a particular printer can also include a flash memory device in place of or in addition to EEPROM 104 and ROM 106.

Printer 100 also includes a disk drive 112, a network interface 114, and a serial/parallel interface 116. Disk drive 112 provides additional storage for data being printed or other information maintained by the printer 100. Although printer 100 is illustrated having both RAM 108 and a disk drive 112, a particular printer may include either RAM 108 or disk drive 112, depending on the storage needs of the printer. For example, an inexpensive printer may include a small amount of RAM 108 and no disk drive 112, thereby reducing the manufacturing cost of the printer.

Network interface 114 provides a connection between printer 100 and a data communication network. The network interface 114 allows devices coupled to a common data communication network to send print jobs, menu data, and other information to printer 100 via the network. Similarly, serial/parallel interface 116 provides a data communication path directly between printer 100 and another electronic or computing device. Although printer 100 is illustrated having a network interface 114 and serial/parallel interface 116, a particular printer may only include one interface component.

Printer 100 also includes a print unit 118 that includes mechanisms arranged to selectively apply an imaging medium such as liquid ink, toner, and the like to a print media in accordance with print data corresponding to a print job. Print media can include any form of media used for printing such as paper, plastic, fabric, Mylar, transparencies, and the like, and different sizes and types such as 8½×11, A4, roll feed media, etc. For example, print unit 118 can include an inkjet printing mechanism that selectively causes ink to be applied to a print media in a controlled fashion. The ink on the print media can then be more permanently fixed to the print media, for example, by selectively applying conductive or radiant thermal energy to the ink. Those skilled in the art will recognize that there are many different types of print units available, and that for the purposes of the present invention, print unit 118 can include any of these different types.

Printer 100 also includes a user interface and menu browser 120, and a display panel 122. The user interface and menu browser 120 allows a user of the printer 100 to navigate the printer's menu structure. User interface 120 can be indicators or a series of buttons, switches, or other selectable controls that are manipulated by a user of the printer. Display panel 122 is a graphical display that provides information regarding the status of the printer 100 and the current options available to a user through the menu structure.

Printer 100 can, and typically does include application components 124 that provide a runtime environment in which software applications or applets can run or execute. Those skilled in the art will recognize that there are many different types of runtime environments available. A runtime environment facilitates the extensibility of printer 100 by allowing various interfaces to be defined that, in turn, allow the application components 124 to interact with the printer.

General reference is made herein to one or more printing devices, such as printing device 100. As used herein, "printing device" means any electronic device having data communications, data storage capabilities, and/or functions to render printed characters and images on a print media. A printing device may be a printer, fax machine, copier, plotter, and the like. The term "printer" includes any type of printing device using a transferred imaging medium, such as ejected ink, to create an image on a print media, and using a servicing assembly to clean imaging medium residue from an imaging medium applicator. Examples of such a printer can include, but are not limited to, inkjet printers, dry medium printers, copiers, facsimile machines, plotters, portable printing devices, cameras, and video printers, as well as multi-function devices such as a combination facsimile/printer or facsimile/scanner. Although specific examples may refer to one or more of these printers, such examples are not meant to limit the scope of the claims or the description, but are meant to provide a specific understanding of the described implementations.

Exemplary Printing Device

Figure 2:
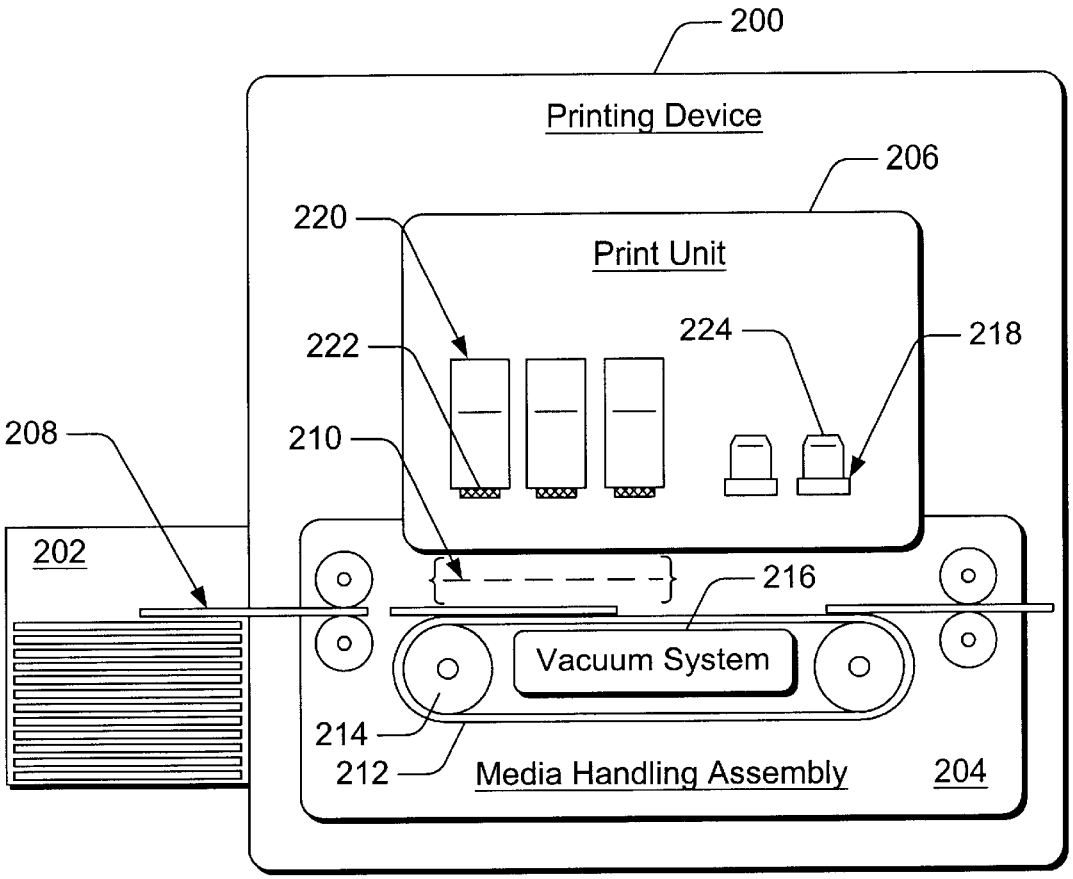
FIG. 2 is an illustration of various components of an exemplary printing device.

FIG. 2 illustrates a printing device 200 that can include one or more of the components of the exemplary printing device 100 (FIG. 1). The various exemplary printing device configurations are described in the environment and context of an inkjet printing device. While it is apparent that printing device components vary from one device to the next, those skilled in the art will recognize the applicability of the present invention to printing devices in general.

Printing device 200 includes a print media container 202, a media handling assembly 204, and a print unit 206. The print media container 202 holds print media 208 until the media handling assembly 204 takes up a print media and routes it through the printing device 200 for printing. The physical path of the print media through a printer is typically referred to as the "print path" or "print media path". When the print media 208 is routed within printing device 200 by the media handling assembly 204, the print media passes through a print region 210 in the printing device. Within print region 210, an imaging medium, such as ink, is transferred from the print unit 206 to print media 208 in response to the printing device 200 receiving print data corresponding to a print job.

The media handling assembly 204 includes components to route print media 208 through the printing device 200. The media handling assembly components include a media routing belt 212 that is positioned to route the print media 208 through the print region 210. The media routing belt 212 can be formed of a metal material, or other material that withstands the structural demands imposed by the printing process, to include localized heat that is generated to permanently fix an imaging medium, such as ink, to a print media.

The media routing belt 212 is driven by a belt drive and/or pulley and roller system 214 which is coupled to a motor drive unit (not shown). Those skilled in the art will recognize that there are any number of media handling assembly configurations that can be implemented in any number of printing devices to route print media through a printing device.

The media handling assembly also includes a vacuum system 216 to hold a print media 208 on the media routing belt 212 while the print media 208 is routed through the printing device 200. The media routing belt 212 can be perforated, or otherwise facilitate air flow through it, such, that the vacuum system 216 located underneath the belt can hold the print media 208 on top of the belt while the print media is routed through the print region 210.

Figure 3:
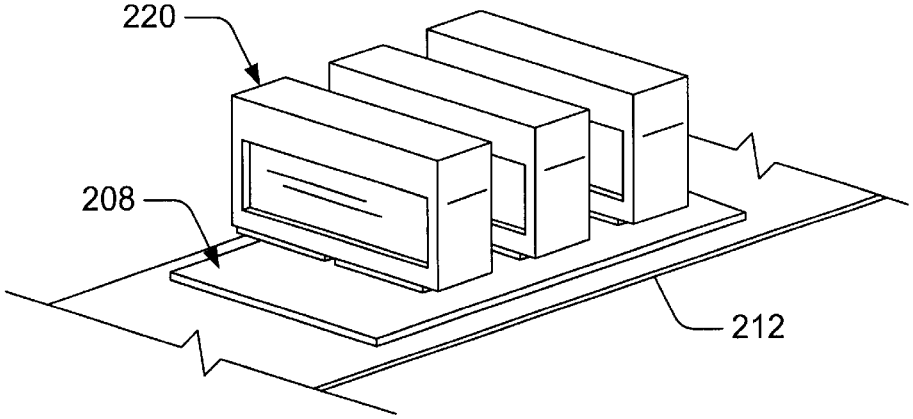
FIG. 3 is an illustration of printbar assemblies positioned for printing a print media.

Print unit 206 includes a servicing assembly 218 and a printbar assembly 220. The print unit 206 can have one or more printbar assemblies to deposit an imaging medium onto a print media 208 within the print region 210. Printbar assembly 220 is illustrated from an end-view, and spans the width of a print media 208 as the print media is routed in printing device 200. FIG. 3 illustrates a configuration of more than one printbar assembly 220 positioned for printing over a print media 208 that is routed in printing device 200 via the media routing belt 212.

Servicing assembly 218 is mounted on, coupled to, and/or otherwise integrated with a printbar assembly 220 to clean nozzle sections of printheads 222 on the printbar assembly 220. A servicing assembly 218 has wipers 224 to clean the printheads 222 and remove ink residue and contaminants to maintain a desired printing quality.

The printheads 222 are cleaned periodically during operation of printing device 200. A processor, or processors, in printing device 200 schedules routine servicing of the printheads based upon the printing time, the number of ink drops being ejected, and/or other printing related factors. For example, the printheads can be cleaned after an approximate time duration, such as after every ten minutes of printing time, or the printheads can be cleaned after a number of print media pages are printed, such as after every one-hundred pages.

Exemplary Printbar Assembly

Figure 4:
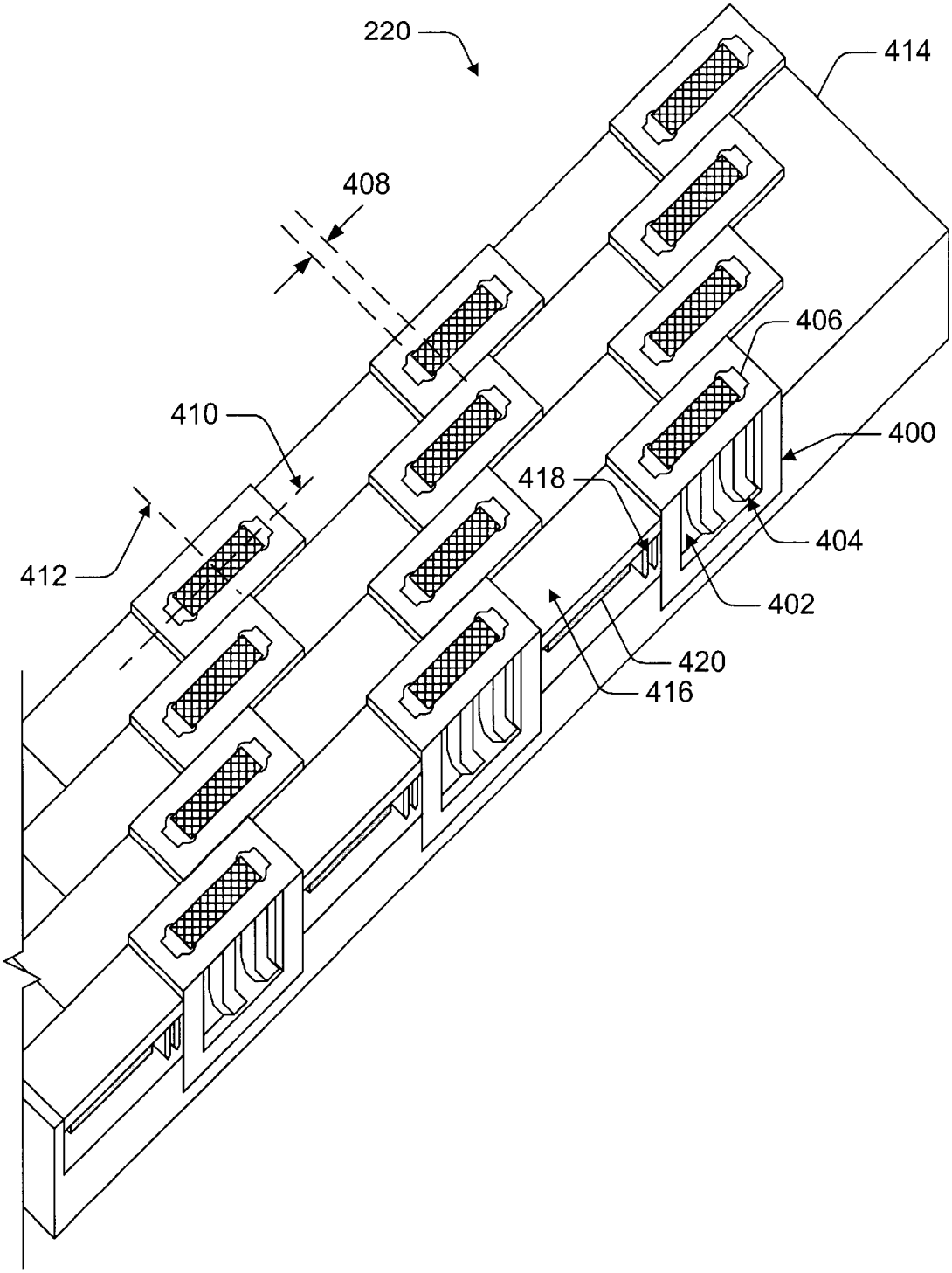
FIG. 4 is an illustration of an exemplary printbar assembly having print modules and integrated servicing assemblies.

FIG. 4 illustrates components of a printbar assembly 220. The printbar assembly 220 is shown having multiple print modules, such as print module 400. Any number of print modules can be combined in a printbar assembly 220 to span the width of a print media, a print region, or span a printing width. A print module is also commonly referred to as a "cartridge", or a "pen". Conventionally, a print module includes an ink reservoir 402 to store a supply of ink and electrical connectors 404 to receive printing control signals from one or more printing device processors.

Print module 400 includes a printhead 406 that has multiple nozzles to eject ink onto a print media to form an image. A printhead is also commonly referred to as a "die". Collectively, the printheads on print bar assembly 220 span a printing width, or a print media width, and overlap to effectively deposit, or transfer, an imaging medium across the printing width without gaps in the imaging medium. For example, the printheads on adjacent print modules have an overlap 408. Each printhead has a longitudinal axis 410 and a transverse axis 412.

The printbar assembly 220 has a framework 414 to support and align the print modules, and to install the printbar assembly in a printing device. Those skilled in the art will recognize that any number of varying framework configurations can be implemented to support the print modules, and the printbar assembly in a printing device.

The printbar assembly framework 414 also supports and integrates servicing assemblies, such as servicing assembly 416. Servicing assembly 416 corresponds to print module 400. Similarly, each print module on the print bar assembly has an integrated, corresponding servicing assembly. Servicing assembly 416 includes wipers 418 to clean printhead 406 and remove ink residue and contaminants. Servicing assembly 416 also includes a printhead cap 420 to cover printhead 406 when printbar assembly 220 is not in use to prevent the ink in the printhead nozzles from drying, and to prevent contaminants from collecting in and over the nozzles.

Figure 5:
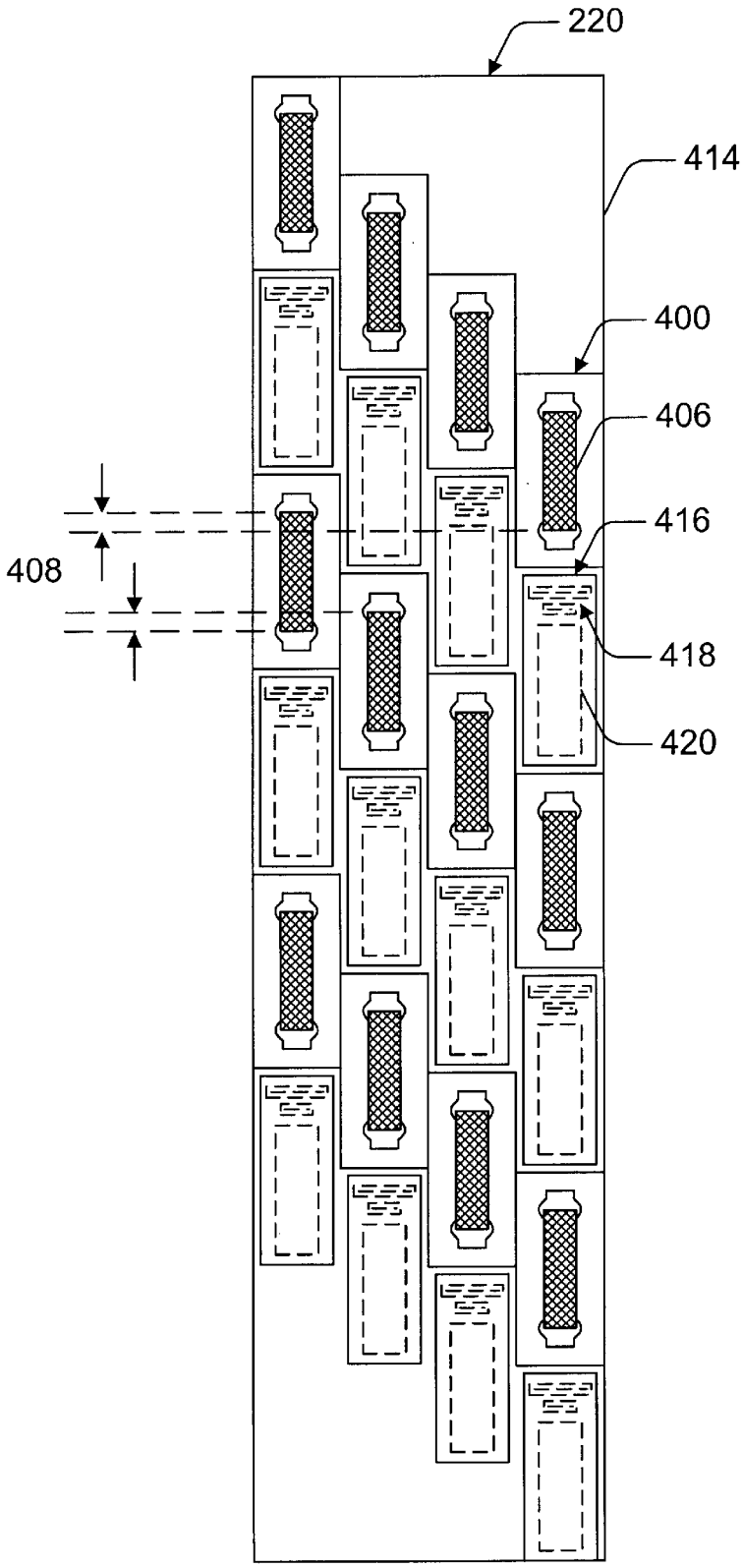
FIG. 5 is an illustration of a bottom view of the exemplary printbar assembly shown in FIG. 4.

FIG. 5 further illustrates the exemplary printbar assembly 220 shown in FIG. 4 from a printhead-side view. Servicing assembly 416 is integrated into printbar assembly 220, and has wipers 418 and a printhead cap 420 shown hidden behind an underside of the servicing assembly in a retracted position. Each servicing assembly corresponds to a print module, such as servicing assembly 416 corresponds to print module 400. Also illustrated is the printhead overlap 408 that allows for depositing, or otherwise transferring, an imaging medium across a printing width without gaps in the imaging medium.

Figure 6:
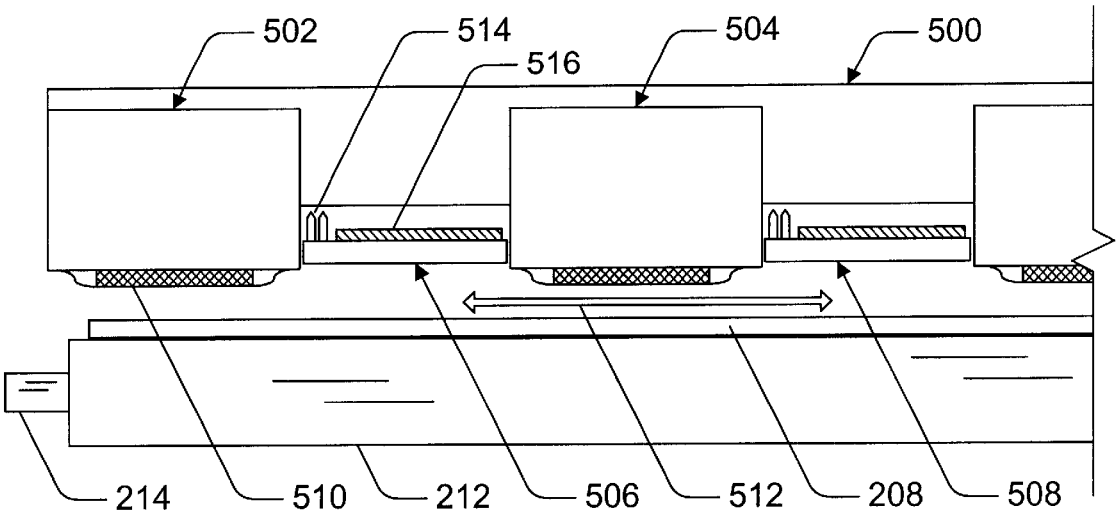
FIG. 6 is an illustration of a side view of the exemplary printbar assembly shown in FIGS. 4 and 5 with integrated servicing assemblies in a print position.

FIG. 6 illustrates an exemplary printbar assembly 500 having print modules 502 and 504, and corresponding integrated servicing assemblies 506 and 508, respectively. The print modules 502 and 504, and the servicing assemblies 506 and 508, are shown in a print position such that the servicing assemblies do not interfere with the print modules when an imaging medium is transferred onto the print media 208. In the print position, servicing assemblies 506 and 508 are retracted into the printbar assembly 500.

Print modules 502 and 504 each have a printhead 510. The printheads of the print modules collectively span a width of a print media 208. Print media 208 is shown from an end-view and is routed in a printing device via the media routing belt 212 (FIG. 2). An arrow 512 identifies a horizontal plane of the print media 208. Servicing assembly 506 includes wipers 514 to clean printhead 510 and remove ink residue and contaminants. Servicing assembly 506 also includes a printhead cap 516 to cover printhead 510 when the printbar assembly 500 is not in use.

Figure 7:
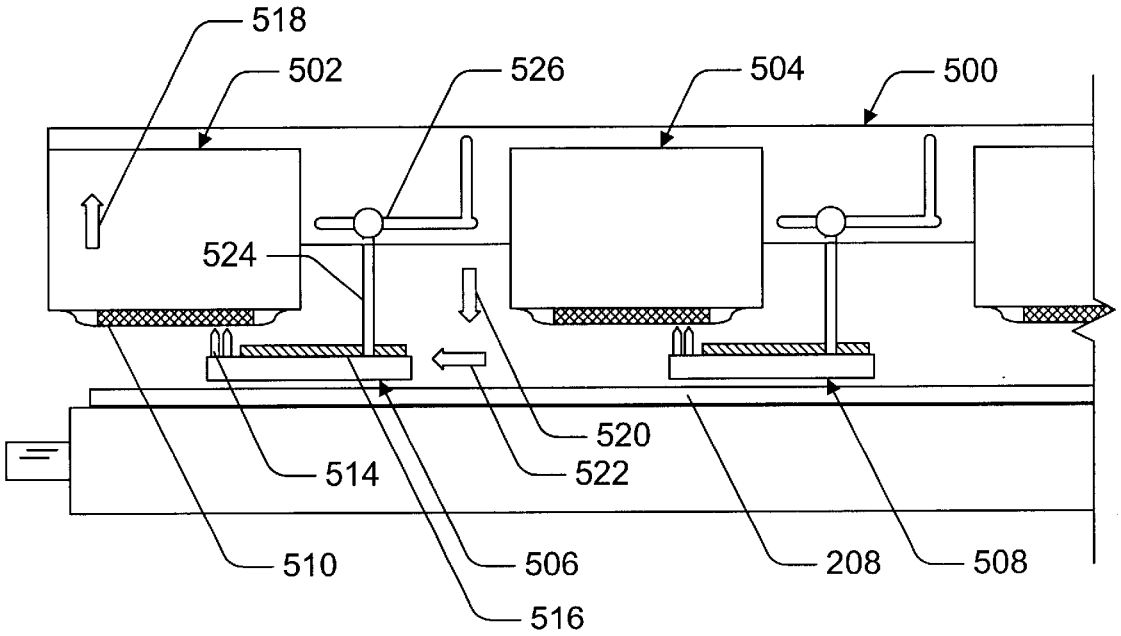
FIG. 7 is an illustration of a side view of the exemplary printbar assembly shown in FIGS. 4 and 5 with integrated servicing assemblies in a service position.

FIG. 7 illustrates the printbar assembly 500 with the print modules 502 and 504, and the servicing assemblies 506 and 508, shown in a service position. Print module 502 moves in a direction indicated by arrow 518 to a print module service position to allow access to clean printhead 510 in a space between printhead 510 and print media 208. Alternatively, printbar assembly 500 can be moved in the direction indicated by arrow 518 to position print modules 502 and 504 in the print module service position together. The direction indicated by arrow 518 is perpendicular to the horizontal plane 512 (FIG. 6) of the print media 208.

Servicing assembly 506 is shown in a servicing assembly service position. The servicing assembly 506 moves in directions indicated by arrows 520 and 522 from a retracted position, as shown in FIG. 6, to the service position shown in FIG. 7. From the service position, the servicing assembly wipers 514 clean printhead 510 when the servicing assembly is moved in a direction that is parallel to a longitudinal axis of the printhead. A direction that is parallel to the longitudinal axis of the printhead corresponds to the direction indicated by arrow 522 which is along the horizontal plane 512 (FIG. 6) of the print media 208. It should be recognized that the movement between the wipers and the printhead is relative, and that the printhead can be moved across the wipers to clean the printhead. Furthermore, for bidirectional wiping, wipers 514 can be moved in a direction indicated by arrow 522, and in a direction that is opposite to the direction indicated by arrow 522 to clean the printhead.

The servicing assembly printhead cap 516 can also be positioned to engage the print module 502 and/or the printhead 510 to cover the printhead when the servicing assembly is in a capping position. It should be recognized that capping movement between the print module 502 and the servicing assembly 506 is relative, and that either or both of the assemblies can be moved such that the printhead cap covers the printhead.

Servicing assembly 506 has a support structure 524 that interconnects with printbar assembly 500 and a servicing assembly positioning mechanism 526. The servicing assembly positioning mechanism 526 can be coupled to a motor drive unit (not shown) to move the servicing assembly 506 from the retracted position to the service position in the directions indicated by arrows 520 and 522. Those skilled in the art will recognize that there are any number of positioning mechanism configurations that can be implemented in any number of printing devices to position a servicing assembly. Furthermore, servicing assemblies 506 and 508 can be configured for movement together, or for independent movement. The support structure 524 and the servicing assembly positioning mechanism 526 interact to maintain contact between wipers 514 and printhead 510 when servicing assembly 506 moves in a direction indicated by arrow 522.

Exemplary Wiper Configurations

Figure 8:
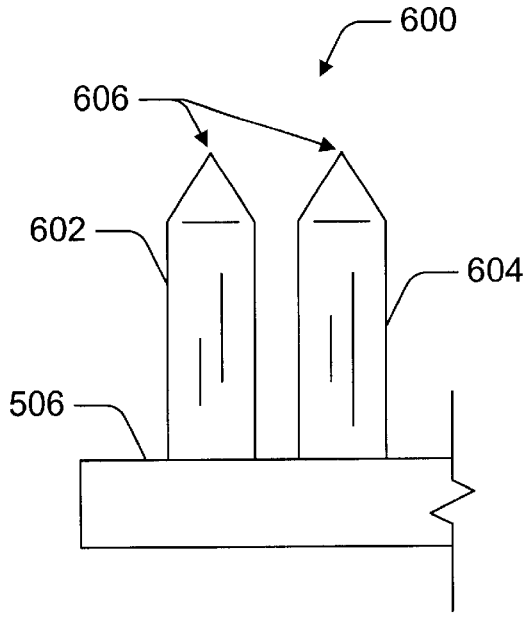
FIG. 8 is an illustration of a servicing assembly having a wiper configuration that includes two wipers.

FIG. 8 illustrates a section of a servicing assembly 506 having a wiper configuration 600 that includes two wipers 602 and 604, although any number of wipers can be configured together to clean a corresponding printhead. The wipers can be configured such that one wiper 602 corresponds to the width of a print module, and the other wiper 604 has a width corresponding to the width of a printhead. Alternatively, the wipers can be configured such that both wipers 602 and 604 are the same width and span at least the width of a printhead, or span the width of a print module.

Each of the wipers 602 and 604 have an elongated blade 606 that engages and wipes associated printhead nozzle sections to remove ink residue and build-up. The blade 606 of a wiper has sufficient width to wipe a cleaning path over all of the printhead nozzles in one pass across a corresponding printhead.

The wipers 602 and 604 can be formed of a resilient, non-abrasive, elastomeric material, such as nitrile rubber, ethylene polypropylene diene monomer (EPDM), or other comparable materials. Those skilled in the art will recognize that the wipers can be made with any number of varying materials, and combinations of materials.

Figure 9:
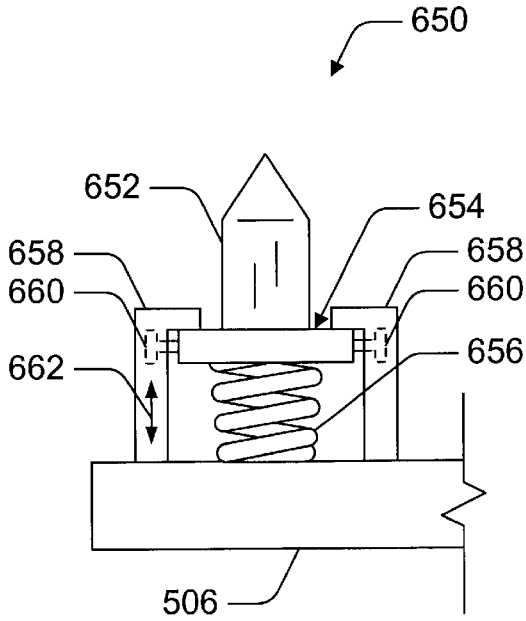
FIG. 9 is an illustration of a servicing assembly having a wiper configuration that includes a spring to apply pressure and hold a wiper in contact with a printhead.

FIG. 9 illustrates a section of a servicing assembly 506 having a wiper configuration 650 that includes a wiper 652 and a spring assembly 654. The configuration 650 can also include any number of wipers positioned together to clean a corresponding printhead, such as two wipers together as shown in configuration 600 (FIG. 8). The spring assembly 654 includes a spring 656 that applies a pressure, or force, to hold the wiper 652 in contact with a printhead while cleaning the printhead. The spring assembly 654 also includes guideposts 658 and slidable members 660 to align travel of the spring assembly in directions indicated by arrows 662.

Additionally, spring assembly 654 compensates for variations in spacing between the servicing assembly 506 and a corresponding printbar assembly that can be caused in part by manufacturing tolerances. Any spacing variations between a servicing assembly and a printbar assembly translate to spacing variations between a wiper and a printhead which can impair the cleaning effectiveness of the wiper due to inadequate contact with the printhead.

Exemplary Printbar Assembly

Figure 10:
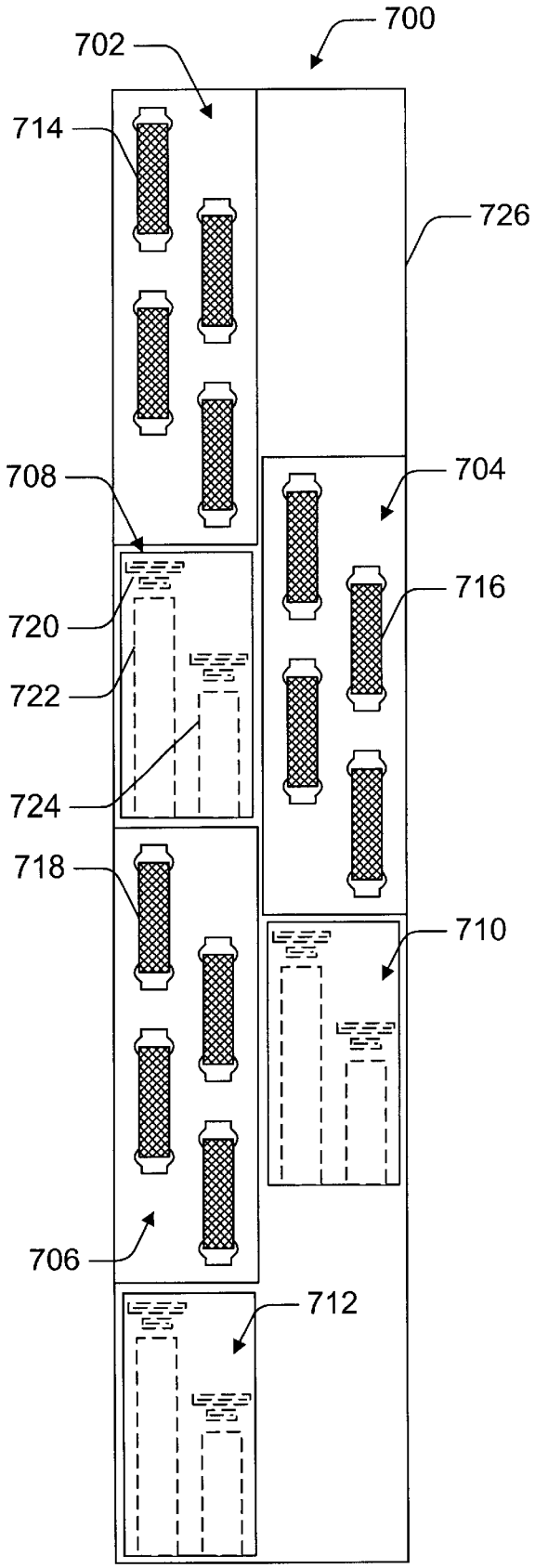
FIG. 10 is an illustration of a bottom view of an exemplary printbar assembly having print modules and integrated servicing assemblies.

FIG. 10 illustrates components of a printbar assembly 700. The printbar assembly 700 is shown having three print modules 702, 704, and 706, although any number of print modules can be combined in a printbar assembly to span the width of a print media, a print region, or span a printing width. The printbar assembly also has servicing assemblies 708, 710, and 712 that correspond to the print modules 702, 704, and 706, respectively.

A print module, such as print module 702, has any number of printheads 714, each having multiple nozzles that eject ink onto a print media to form an image. Print module 704 has multiple printheads such as printhead 716, and print module 706 has multiple printheads such as printhead 718. Collectively, the printheads on print bar assembly 700 span a printing width, or a print media width, and overlap to effectively deposit, or transfer, an imaging medium across the printing width without gaps in the imaging medium.

A servicing assembly, such as servicing assembly 708, includes wipers 720 to clean printheads 714 on print module 702 and remove ink residue and contaminants. Servicing assembly 708 also includes a printhead cap 722 to cover printheads 714 when printbar assembly 700 is not in use to prevent the ink in the printhead nozzles from drying, and to prevent contaminants from collecting in and over the nozzles. Servicing assembly 708 is shown having two printhead caps 722 and 724 that each cover two of the printheads 714 on print module 702. Alternatively, servicing assembly 708 can have one printhead cap wide enough and long enough to cover all of the printheads 714 on print module 702.

Printbar assembly 700 also has a framework 726 to support and align the print modules and the integrated servicing assemblies, and to install the printbar assembly in a printing device. Those skilled in the art will recognize that any number of varying framework configurations can be implemented to support the print modules and servicing assemblies, and the printbar assembly in a printing device.

Figure 11:
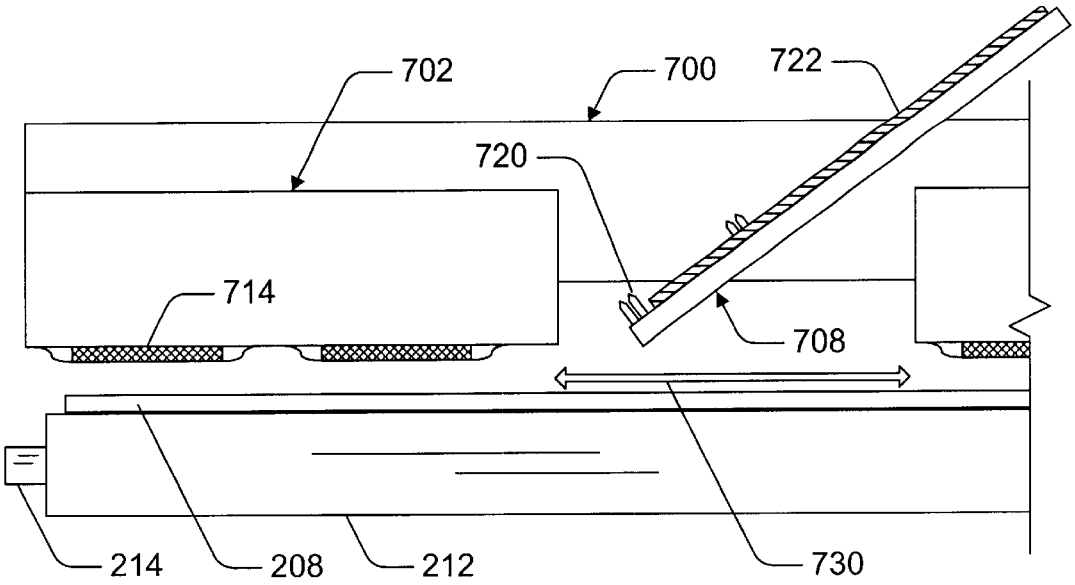
FIG. 11 is an illustration of a side view of the exemplary printbar assembly shown in FIG. 10 with integrated servicing assemblies in a print position.

FIG. 11 illustrates a side view of the exemplary printbar assembly 700 shown in FIG. 10 with print module 702 and corresponding integrated servicing assembly 708 shown in a print position. In the print position, servicing assembly 708 is retracted into the printbar assembly 700 such that the servicing assembly 708 does not interfere with the print module when an imaging medium is transferred onto the print media 208.

Print module 702 has multiple printheads 714, and the multiple printheads of the print modules collectively span a width of a print media 208. Print media 208 is shown from an end-view and is routed in a printing device via the media routing belt 212 (FIG. 2). An arrow 730 identifies a horizontal plane of the print media 208. Servicing assembly 708 includes wipers 720 to clean printheads 714 and remove ink residue and contaminants. Servicing assembly 708 also includes a printhead cap 722 to cover the printheads 714 when the printbar assembly 700 is not in use.

Figure 12:
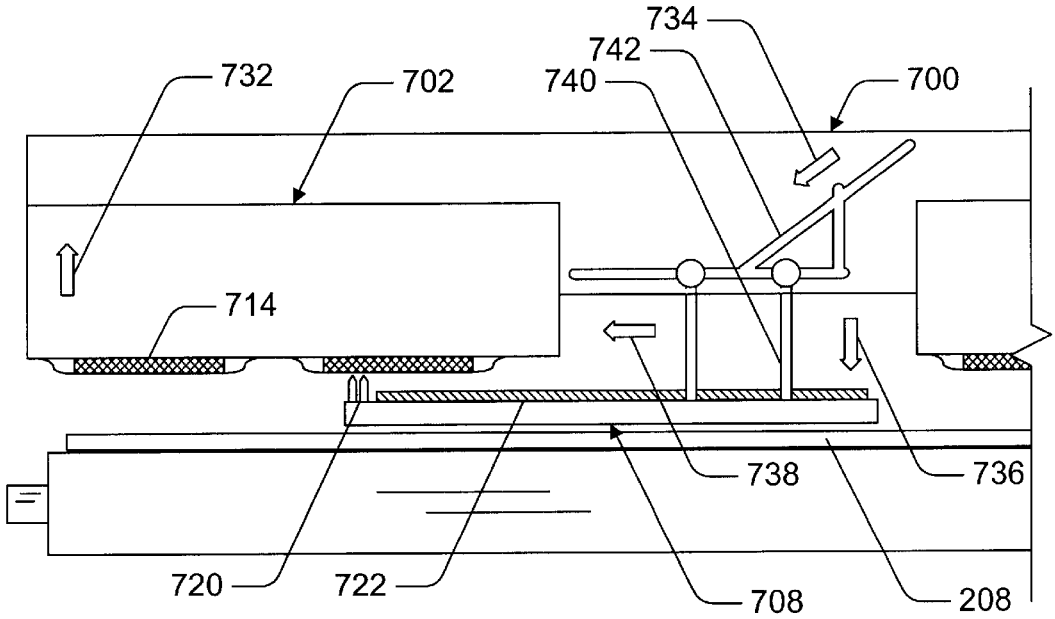
FIG. 12 is an illustration of a side view of the exemplary printbar assembly shown in FIG. 10 with integrated servicing assemblies in a service position.

FIG. 12 illustrates the printbar assembly 700 with the print module 702 and the servicing assembly 708 shown in a service position. Print module 702 moves in a direction indicated by arrow 732 to a print module service position to allow access to clean printheads 714 in a space between the printhead 714 and print media 208. Alternatively, printbar assembly 700 can be moved in the direction indicated by arrow 732 to position print module 702 in the print module service position. The direction indicated by arrow 732 is perpendicular to the horizontal plane 730 (FIG. 11) of the print media 208.

Servicing assembly 708 is shown in a servicing assembly service position. The servicing assembly 708 moves in directions indicated by arrows 734, 736, and 738 from a retracted position, as shown in FIG. 11, to the service position shown in FIG. 12. From the service position, the servicing assembly wipers 720 clean the printheads 714 when the servicing assembly is moved in a direction that is parallel to a longitudinal axis of the printheads. A direction that is parallel to the longitudinal axis of the printheads corresponds to the direction indicated by arrow 738 which is along the horizontal plane 730 of the print media 208. It should be recognized that the movement between the wipers and the printheads is relative, and that the printheads can be moved across the wipers to clean the printheads. Furthermore, for bi-directional wiping, wipers 514 can be moved in a direction indicated by arrow 738, and in a direction that is opposite to the direction indicated by arrow 738 to clean the printheads.

The servicing assembly printhead cap 722 can also be positioned to engage print module 702 and/or the printheads 714 to cover the printheads when the servicing assembly is in a capping position. It should be recognized that capping movement between the print module 702 and the servicing assembly 708 is relative, and that either or both of the assemblies can be moved such that the printhead cap covers the printheads.

Servicing assembly 708 has a support structure 740 that interconnects with printbar assembly 700 and a servicing assembly positioning mechanism 742. The servicing assembly positioning mechanism 742 can be coupled to a motor drive unit (not shown) to move the servicing assembly 708 from the retracted position to the service position in the directions indicated by arrows 734, 736, and 738. Those skilled in the art will recognize that there are any number of positioning mechanism configurations that can be implemented in any number of printing devices to position a servicing assembly. Furthermore, servicing assembly 708 can be configured for movement together with other servicing assemblies integrated into the printbar assembly 700, or the servicing assembly 708 can be configured for independent movement. The support structure 740 and the servicing assembly positioning mechanism 742 interact to maintain contact between wipers 720 and printheads 714 when servicing assembly 708 moves in a direction indicated by arrow 738.

Methods for Servicing with Integrated Servicing Assemblies

Figure 13:
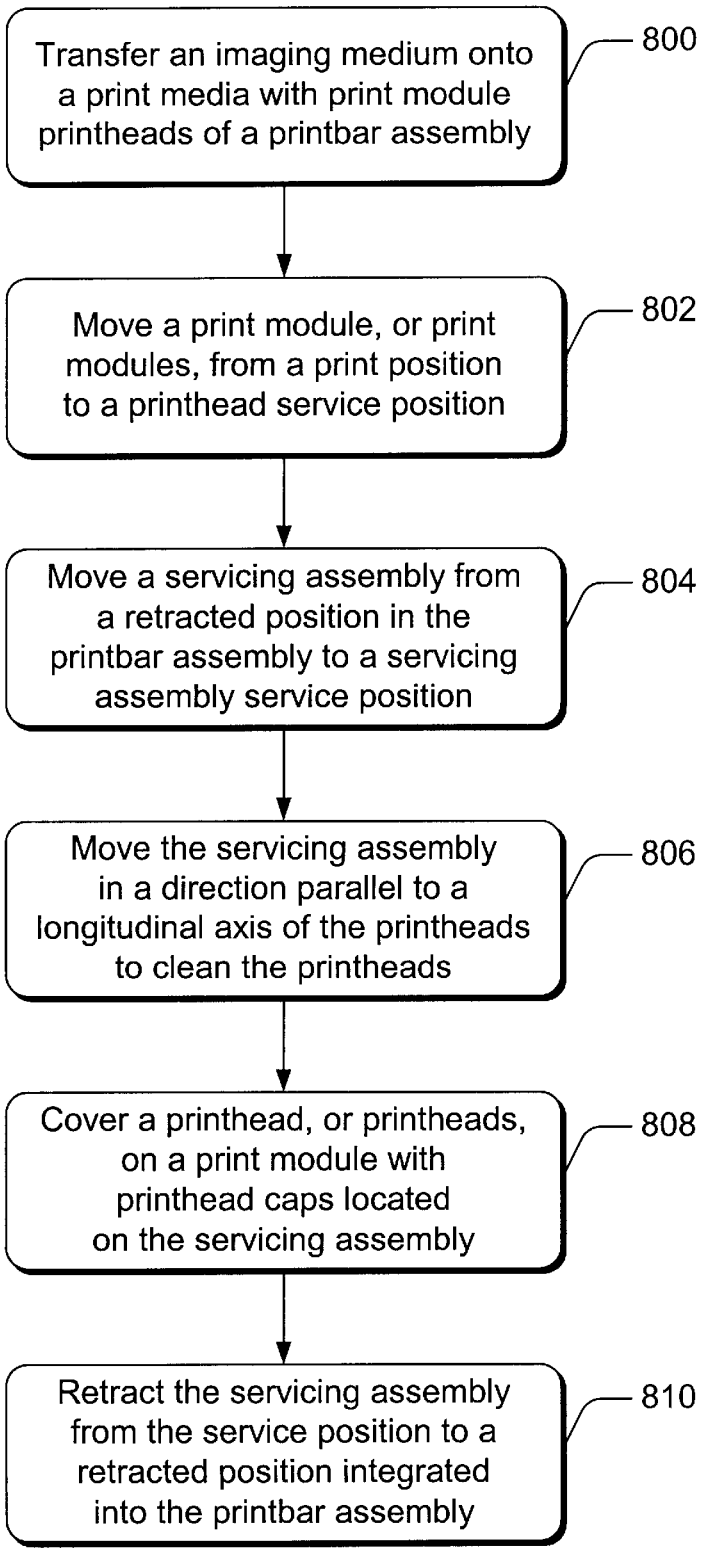
FIG. 13 is a flow diagram that describes a method for servicing a print module with an integrated servicing assembly in a printbar assembly.

FIG. 13 illustrates a method for servicing a print module with an integrated servicing assembly in a printbar assembly. The order in which the method is described is not intended to be construed as a limitation. Furthermore, the method can be implemented in any suitable hardware, software, firmware, or combination thereof. In addition, the method can be implemented by one or more processors executing instructions that are maintained on a computer-readable media.

At block 800, an imaging medium, such as ink, is transferred onto a print media with printheads of a printbar assembly. Print modules coupled to the printbar assembly have one or more printheads that collectively span a width of the print media, or a print region, when the printbar assembly is in a print position.

At block 802, a print module is moved from the print position to a printhead service position. The printhead modules coupled to the printbar assembly can be moved independently, or together by moving the printbar assembly itself. The print module, or print modules, are moved to allow access to the printheads for servicing. The print modules can be moved up from the print position in a direction perpendicular to a horizontal plane of the print media.

At block 804, a servicing assembly is moved from a retracted position in the printbar assembly to a servicing assembly service position. Integrated servicing assemblies can be moved independently, or together, to position one or more wipers coupled, to the servicing assembly in contact with the printhead, or printheads, on a print module.

At block 806, a printhead, or printheads, on a print module are serviced with wipers on a servicing assembly. The servicing assembly is moved in a direction parallel to a longitudinal axis of the printheads such that the wipers clean the printheads. For bi-directional wiping, the servicing assembly can be moved in a first direction, and then in a second direction opposite to the first direction to clean the printheads.

At block 808, a printhead, or printheads, on a print module are covered with a printhead cap coupled to a servicing assembly. The capping movement between the printbar assembly and the servicing assembly is relative, such that either or both of the assemblies can be moved to cover the printheads with the printhead caps.

At block 810, a servicing assembly is retracted from a service position to a retracted position in the printbar assembly. A servicing assembly in the retracted position is integrated into the printbar assembly so as not to interfere with transferring an imaging medium onto a print media.

Conclusion

A printbar assembly having print modules and integrated servicing assemblies provides a single compact unit, rather than having both a printbar assembly and a separate servicing assembly. The integrated servicing assemblies can be quickly moved to a service position to clean the printheads on the print modules when the servicing assemblies are integrated into the printbar assembly in close proximity to the printheads.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. An inkjet printing mechanism, comprising:

one or more printbar assemblies;

one or more print modules coupled to a printbar assembly, an individual print module having one or more printheads, the one or more printheads of the one or more print modules collectively configured to span a width of a print media; and one or more servicing assemblies coupled to the printbar assembly, an individual servicing assembly corresponding to the individual print module and configured for movement between a first position and a second position to service the one or more printheads on the individual print module.

2. An inkjet printing mechanism as recited in claim 1, wherein the one or more servicing assemblies are configured for movement together between the first position and the second position.

3. An inkjet printing mechanism as recited in claim 1, wherein the one or more servicing assemblies are configured for individual movement between the first position and the second position.

4. An inkjet printing mechanism as recited in claim 1, wherein the individual servicing assembly is positioned so as not to interfere with the one or more printheads on the individual print module in the first position when the one or more printheads deposit ink onto the print media.

5. An inkjet printing mechanism as recited in claim 1, wherein the individual servicing assembly is retracted into the printbar assembly in the first position.

6. An inkjet printing mechanism as recited in claim 1, wherein the individual servicing assembly has one or more wipers positioned to clean the one or more printheads on the individual print module when in the second position.

7. An inkjet printing mechanism as recited in claim 1, wherein the individual servicing assembly has one or more printhead caps positioned to cover the one or more printheads on the individual print module when in the second position, and wherein the individual servicing assembly is further configured for movement to cover the one or more printheads with the one or more printhead caps.

8. An inkjet printing mechanism as recited in claim 1, wherein the individual servicing assembly is retracted into the printbar assembly in the first position, and wherein the individual servicing assembly has one or more wipers positioned to clean the one or more printheads on the individual print module when in the second position.

9. An inkjet printing mechanism as recited in claim 1, wherein:

the individual servicing assembly is retracted into the printbar assembly in the first position;

the individual servicing assembly has one or more printhead caps positioned to cover the one or more printheads on the individual print module when in the second position; and the individual servicing assembly is further configured for movement to cover the one or more printheads with the one or more printhead caps.

10. An inkjet printing mechanism as recited in claim 1, wherein the one or more printbar assemblies are configured for movement to a service position, and wherein the individual servicing assembly is positioned to clean the one or more printheads on the individual print module when in the second position.

11. An inkjet printing mechanism as recited in claim 1, wherein the individual print module is configured for movement to a service position, and wherein the individual servicing assembly is positioned to clean the one or more printheads on the individual print module when in the second position.

12. An inkjet printing mechanism as recited in claim 1, wherein the one or more printbar assemblies are configured for movement in a direction perpendicular to a horizontal plane of the print media to a service position, and wherein the individual servicing assembly is positioned to clean the one or more printheads on the individual print module when in the second position.

13. An inkjet printing mechanism as recited in claim 1, wherein the one or more printbar assemblies are configured for movement in a direction perpendicular to a horizontal plane of the print media to a service position, and wherein the individual servicing assembly is positioned between the print media and the individual print module to clean the one or more printheads on the individual print module when in the second position.

14. An inkjet printing mechanism as recited in claim 1, wherein the one or more printbar assemblies are configured for movement in a direction perpendicular to a horizontal plane of the print media to a service position, and wherein the individual servicing assembly is positioned between the print media and the individual print module when in the second position, and further configured for movement in a direction parallel to a longitudinal axis of the one or more printheads on the individual print module to clean the one or more printheads.

15. An inkjet printing mechanism as recited in claim 1, wherein:

the one or more printbar assemblies are configured for movement to a service position;

the individual servicing assembly is retracted into the printbar assembly in the first position; and the individual servicing assembly is configured for movement from the first position to the second position such that wipers on the individual servicing assembly are positioned to clean the one or more printheads on the individual print module.

16. An inkjet printing mechanism as recited in claim 1, wherein:

the one or more printbar assemblies are configured for movement to a service position;

the individual servicing assembly is retracted into the printbar assembly in the first position;

the individual servicing assembly is configured for movement from the first position to the second position such that printhead caps on the individual servicing assembly are positioned to cover the one or more printheads on the individual print module; and the individual servicing assembly is further configured for movement to cover the one or more printheads with the printhead caps.

17. An inkjet printing mechanism as recited in claim 1, wherein:

the individual print module is configured for movement to a service position;

the individual servicing assembly is retracted into the printbar assembly in the first position; and the individual servicing assembly is configured for movement from the first position to the second position such that wipers on the individual servicing assembly are positioned to clean the one or more printheads on the individual print module.

18. An inkjet printing mechanism as recited in claim 1, wherein:

the individual print module is configured for movement to a service position;

the individual servicing assembly is retracted into the printbar assembly in the first position;

the individual servicing assembly is configured for movement from the first position to the second position such that printhead caps on the individual servicing assembly are positioned to cover the one or more printheads on the individual print module; and the individual servicing assembly is further configured for movement to cover the one or more printheads with the printhead caps.

19. A print unit, comprising:

one or more print modules, an individual print module having one or more printheads, the one or more printheads of the one or more print modules collectively configured to span a print region; and one or more servicing assemblies, an individual servicing assembly configured for movement between a retracted position and a service position to service the one or more printheads on the individual print module.

20. A print unit as recited in claim 19, wherein the one or more servicing assemblies are configured for movement together between the retracted position and the service position.

21. A print unit as recited in claim 19, wherein the one or more servicing assemblies are configured for individual movement between the retracted position and the service position.

22. A print unit as recited in claim 19, wherein the individual servicing assembly is positioned so as not to interfere with the one or more printheads on the individual print module in the retracted position when the one or more printheads transfer an imaging medium onto a print media.

23. A print unit as recited in claim 19, wherein the individual servicing assembly has one or more wipers positioned to clean the one or more printheads on the individual print module when in the service position.

24. A print unit as recited in claim 19, wherein the individual servicing assembly has one or more printhead caps positioned to cover the one or more printheads on the individual print module when in the service position, and wherein the individual servicing assembly is further configured for movement to cover the one or more printheads with the one or more printhead caps.

25. A print unit as recited in claim 19, wherein the one or more print modules are configured for movement together to a print module service position, and wherein the individual servicing assembly is positioned to clean the one or more printheads on the individual print module when in the service position.

26. A print unit as recited in claim 19, wherein the individual print module is configured for individual movement to a print module service position, and wherein the individual servicing assembly is positioned to clean the one or more printheads on the individual print module when in the service position.

27. A print unit as recited in claim 19, wherein the one or more print modules are configured for movement in a direction perpendicular to a horizontal plane of the print region to a print module service position, and wherein the individual servicing assembly has one or more wipers positioned to clean the one or more printheads on the individual print module when in the service position.

28. A print unit as recited in claim 19, wherein the one or more print modules are configured for movement in a direction perpendicular to a horizontal plane of the print region to a print module service position, and wherein the individual servicing assembly has one or more wipers, and is further configured for movement from the service position in a direction parallel to a longitudinal axis of the one or more printheads on the individual print module to clean the one or more printheads.

29. A print unit as recited in claim 19, wherein the one or more print modules are configured for movement together to a print module service position, and wherein the individual servicing assembly is configured for movement from the retracted position to the service position such that wipers on the individual servicing assembly are positioned to clean the one or more printheads on the individual print module.

30. A print unit as recited in claim 19, wherein:

the one or more print modules are configured for movement together to a print module service position;

the individual servicing assembly is configured for movement from the retracted position to the service position such that printhead caps on the individual servicing assembly are positioned to cover the one or more printheads on the individual print module; and the individual servicing assembly is further configured for movement to cover the one or more printheads with the printhead caps.

31. A print unit as recited in claim 19, wherein the individual print module is configured for individual movement to a print module service position, and wherein the individual servicing assembly is configured for movement from the retracted position to the service position such that wipers on the individual servicing assembly are positioned to clean the one or more printheads on the individual print module.

32. A print unit as recited in claim 19, wherein:

the individual print module is configured for individual movement to a print module service position;

the individual servicing assembly is configured for movement from the retracted position to the service position such that printhead caps on the individual servicing assembly are positioned to cover the one or more printheads on the individual print module; and the individual servicing assembly is further configured for movement to cover the one or more printheads with the printhead caps.

33. A method, comprising:

transferring an imaging medium onto a print media with one or more printheads coupled to a printbar assembly, the one or more printheads collectively spanning a width of the print media;

servicing an individual printhead with a servicing assembly coupled to the printbar assembly; and retracting the servicing assembly into the printbar assembly after servicing.

34. A method as recited in claim 33, further comprising servicing each of the one or more printheads together with corresponding one or more servicing assemblies coupled to the printbar assembly.

35. A method as recited in claim 33, further comprising servicing each of the one or more printheads together with corresponding one or more servicing assemblies coupled to the printbar assembly, and further comprising retracting the one or more servicing assemblies into the printbar assembly.

36. A method as recited in claim 33, further comprising moving the individual printhead to a printhead service position.

37. A method as recited in claim 33, further comprising moving the one or more printheads together to a printhead service position, and further comprising servicing each of the one or more printheads together with one or more servicing assemblies coupled to the printbar assembly.

38. A method as recited in claim 33, wherein retracting comprises moving the servicing assembly from a service position to a retracted position.

39. A method as recited in claim 33, wherein retracting comprises positioning the servicing assembly so as not to interfere with the transferring.

40. A method as recited in claim 33, wherein servicing comprises cleaning the individual printhead with one or more wipers coupled to the servicing assembly.

41. A method as recited in claim 33, further comprising positioning one or more wipers coupled to the servicing assembly to contact the individual printhead, and wherein servicing comprises cleaning the individual printhead with the one or more wipers.

42. A method as recited in claim 33, further comprising capping the individual printhead with a printhead cap coupled to the servicing assembly.

43. A method as recited in claim 33, further comprising positioning a printhead cap coupled to the servicing assembly to engage the individual printhead, and capping the individual printhead with the printhead cap.

44. A method for servicing an inkjet printhead on a printbar assembly in an inkjet printing device, the method comprising:

moving a servicing assembly from a retracted position in the printbar assembly to a service position such that one or more wipers coupled to the servicing assembly contact the inkjet printhead;

cleaning the inkjet printhead with the one or more wipers by moving the servicing assembly in at least a direction parallel to a longitudinal axis of the inkjet printhead; and moving the servicing assembly from the service position to the retracted position such that the servicing assembly is integrated into the printbar assembly.

45. A method as recited in claim 44, further comprising moving the servicing assembly from the retracted position in the printbar assembly to the service position such that a printhead cap engages the inkjet printhead, and further comprising capping the inkjet printhead with the printhead cap by moving the servicing assembly in a direction perpendicular to a horizontal plane of the inkjet printhead.

46. A method as recited in claim 44, further comprising moving the inkjet printhead to a printhead service position before cleaning.

47. A method as recited in claim 44, further comprising moving the inkjet printhead to a printhead service position before cleaning by moving the printbar assembly.

48. One or more computer-readable media comprising executable instructions that, when executed, direct one or more processors in an inkjet printing device to:

position a servicing assembly in a service position such that one or more wipers on the servicing assembly contact a printhead on a printbar assembly;

move the servicing assembly in a direction that is parallel to a longitudinal axis of the printhead such that the one or more wipers clean the printhead; and retract the servicing assembly to retracted position such that the servicing assembly is integrated into the printbar assembly.

49. One or more computer-readable media as recited in claim 48, further comprising executable instructions that, when executed, direct the one or more processors to move the servicing assembly to cap the printhead with a printhead cap coupled to the servicing assembly.

* * * * *